US007001131B2

(12) United States Patent
O'Keeffe

(10) Patent No.: US 7,001,131 B2
(45) Date of Patent: Feb. 21, 2006

(54) FORKLIFT LOADING SUPPORT

(75) Inventor: Eric O'Keeffe, Monaghan (IE)

(73) Assignee: Moffett Research and Development Limited, Louth (IE)

( * ) Notice: Subject to any disclaimer, the term of this patent is extended or adjusted under 35 U.S.C. 154(b) by 0 days.

(21) Appl. No.: 10/414,484

(22) Filed: Apr. 16, 2003

(65) Prior Publication Data

US 2004/0179925 A1 Sep. 16, 2004

(30) Foreign Application Priority Data

Mar. 14, 2003 (IE) ..... 2003/0193

(51) Int. Cl.
*B60P 1/04* (2006.01)

(52) U.S. Cl. ..... 414/467; 414/659; 414/660; 414/661

(58) Field of Classification Search ..... 414/467, 414/659, 660, 661
See application file for complete search history.

(56) References Cited

U.S. PATENT DOCUMENTS 3,157,301 A * 11/1964 McWilliams ..... 414/792.8
4,345,873 A * 8/1982 Wymore ..... 414/714
4,460,064 A * 7/1984 Lutz et al. ..... 187/222
4,826,474 A * 5/1989 Holmes ..... 414/699
4,954,041 A * 9/1990 Dahlquist et al. ..... 414/718
5,437,531 A * 8/1995 Kress ..... 414/555
5,641,261 A * 6/1997 Talbert et al. ..... 414/544
6,530,739 B1 * 3/2003 Fridman ..... 414/467
6,641,355 B1 * 11/2003 McInerney et al. ..... 414/685

FOREIGN PATENT DOCUMENTS

EP 0367356 A1 5/1990
GB 1575911 10/1980
GB 2259292 A 3/1993

* cited by examiner

*Primary Examiner*—Eileen D. Lillis
*Assistant Examiner*—Michael Lowe
(74) *Attorney, Agent, or Firm*—Jacobson Holman PLLC

(57) ABSTRACT

A forklift (1) of the type adapted to be transported on a carrying vehicle comprising a wheeled chassis (6) on which are mounted a pair of platform engaging load rest supports (15). The load rest supports (15) comprise a pair of spaced-apart upright bars (20) which have a contact surface for engagement at Y of a platform (2). The forklift truck (1) also has a mast (8) carrying extendable forks (9) to allow a load (3) to be placed on and removed from an extended position across the platform. The load rest support (15) allows the mast (8) to be tilted and if the mast (8) can also be side-shifted, then it can be side-shifted without interference with the platform (2). This further prevents tilting of the forklift (1) in the direction of the arrow A.

90 Claims, 12 Drawing Sheets

1
2
3
5
6
7
8
9
10
19
20
22
23
24

FORKLIFT LOADING SUPPORT

FIELD OF THE INVENTION

The present invention relates to a forklift truck of the type adapted to be transported on a carrying vehicle and comprising a wheeled chassis mounting an upright mast carrying forks and means for altering the reach of the forks relative to the mast to remove and place loads on a raised platform.

Typically, the chassis is of a U-shape and the upright mast is mounted on a carriage which can be reciprocated forwards and backwards within the chassis frame. The mast can also be shifted sidewards relative to the chassis.

BACKGROUND OF THE INVENTION

Such forklift trucks are called "piggy-back" forklifts or "truck mounted" forklifts. Because of the fact that they are transported on other vehicles and trailers, they are, of necessity, of lightweight construction. A typical example of such a forklift is that disclosed in GB Patent Specification No. 2259292 (Moffett Research and Development Limited). A problem arises when they have to load and unload onto platforms where added reach and capacity is required. It is well known to have forklift trucks with means for altering the reach of the forks relative to the mast, either by providing a pantograph linkage or other mechanism between a fork carriage supporting the forks and the mast. European Patent Specification No. 0367356A (Kool Beheer BV) discloses such a pantograph arrangement. Another arrangement comprises using extendable or telescopic forks to provide the reach, such as disclosed in GB Patent Specification No. 1575911 (George E Herbertson). Various other arrangements have been provided, all of which, to a greater or lesser degree, facilitate extendable reach.

However, there are problems associated with this extended reach. Because of the relatively lightweight of the forklift, when the capacity is exceeded by trying to lift something at extended reach, the forklift will overbalance. When extra reach is required, extra forklift capacity is also required. Until now, the extra capacity could only be found by increasing the weight of the forklift. However, the weight of the forklift is critical and so until now, the extended reach across trailers or other platforms with these types of forklift has been limited. In this specification, the term "platform" is used to cover not just simply platforms per se, that is to say, rigid platforms, but indeed trailers, trucks and the like, onto and off which loading is required.

A further problem with the additional loading is that, when the forks are extended, this causes the mast to bear against the platform making it virtually impossible to tilt or side-shift the mast making it very difficult to remove loads from platforms. Further, any form of side shift of the mast becomes almost impossible because the load is such, very often, to bear the forks down against the platform and effectively jam the forks. Various arrangements have been provided to overcome these problems, including the provision of rollers beneath the forks, however, while these solutions have afforded some advantages, they have not allowed the forklift truck to operate in the correct manner. The problem is that the forklift tends to tip under the load. Anything which would prevent this is desirable.

The present invention is directed towards overcoming these problems.

SUMMARY OF THE INVENTION

According to the invention, there is provided a forklift truck of the type adapted to be transported on a carrying vehicle and comprising a wheeled chassis mounting an upright mast carrying forks and means for altering the reach of the forks relative to the mast to remove and place loads on a raised platform. In accordance with the invention, the chassis mounts a platform engaging load rest support having a contact surface for engagement against a facing surface of the platform. Such a platform may, for example, be a fixed platform or could, as will often be the case, be a truck or a trailer body. Since the mast is no longer in contact with the platform or trailer onto or off which it is moving loads, the mast can tilt and indeed, if it is, for example, a side-shifting mast, it can also shift sidewards. This further increases the ease of operation of the forklift. Loads can be relatively easily placed in position and removed without difficulty and much more safely than heretofore.

One particularly suitable construction of forklift truck has a chassis of U-shape comprising a base frame mounting a rear steering wheel or wheels with a mast carriage carrying the mast, and a pair of forwardly projecting side frames, each side frame mounting a front wheel and a rest support. Ground engaging stabilising jacks are usually, if not nearly always, provided.

It is envisaged that the means for altering the reach of the forks may comprise extendable forks, pantograph linkage or any other type of extended reach device which extends the forks away from the mast.

In one forklift in accordance with the invention, the contact surface of the rest support is substantially vertically in line with the foremost contact between the chassis and the ground. By having the jack legs usually provided with a forklift, effectively in line with the contact between the rest support and the platform, there will be relatively little turning movement to cause the forklift to unbalance.

Ideally, the contact surface of the rest support is rearward of the foremost contact between the chassis and the ground. Unfortunately, this is not always possible because very often, for example, in loading trucks or trailers, this would cause the jack legs to damage the tyres of the vehicle. However, when this can be achieved, there is a positive moment preventing toppling of the forklift inwards towards the platform. This will further secure the load, making for much more stable load handling and thus added safety.

The rest support may be tilted slightly forwards so that in the operative position and prior to full contact with the platform, the contact surface is inclined forwardly.

In one embodiment of the invention, there are a pair of spaced-apart rest supports mounted on the chassis on either side of the mast. For instance, with a forklift truck having a U-shaped chassis, a rest support is conveniently mounted on each side frame.

The rest support is provided by an upright bar mounted on the chassis which bar may be pivotally mounted with the respect to the chassis. A ram connected between the bar and the chassis for raising and lowering the bar.

Many ways of mounting the rest support on the chassis may be provided. Very often, it is important to make sure that the rest support does not in any way interfere with the operation of the forklift and in particular, the mounting of the forklift on a carrying vehicle. Thus, one particularly suitable construction of rest support has a base frame pivotally mounted adjacent one end thereof on the chassis and a bar pivotally mounted at the other end of the base frame. Then, a ram is connected at one end of the bar and releasably connected at its other end to the chassis for raising and lowering the bar.

Indeed, connection means may be provided for releasably connecting the ram to the chassis. One construction of such connection means comprises a hook mounted at one end of the ram for engagement with a transversely arranged frame locking pin mounted above and spaced-apart from the chassis. Indeed, further locking means may be provided for retaining the base frame in an upright storage position on the chassis.

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF THE PREFERRED EMBODIMENTS

Figures 1A, 1B:
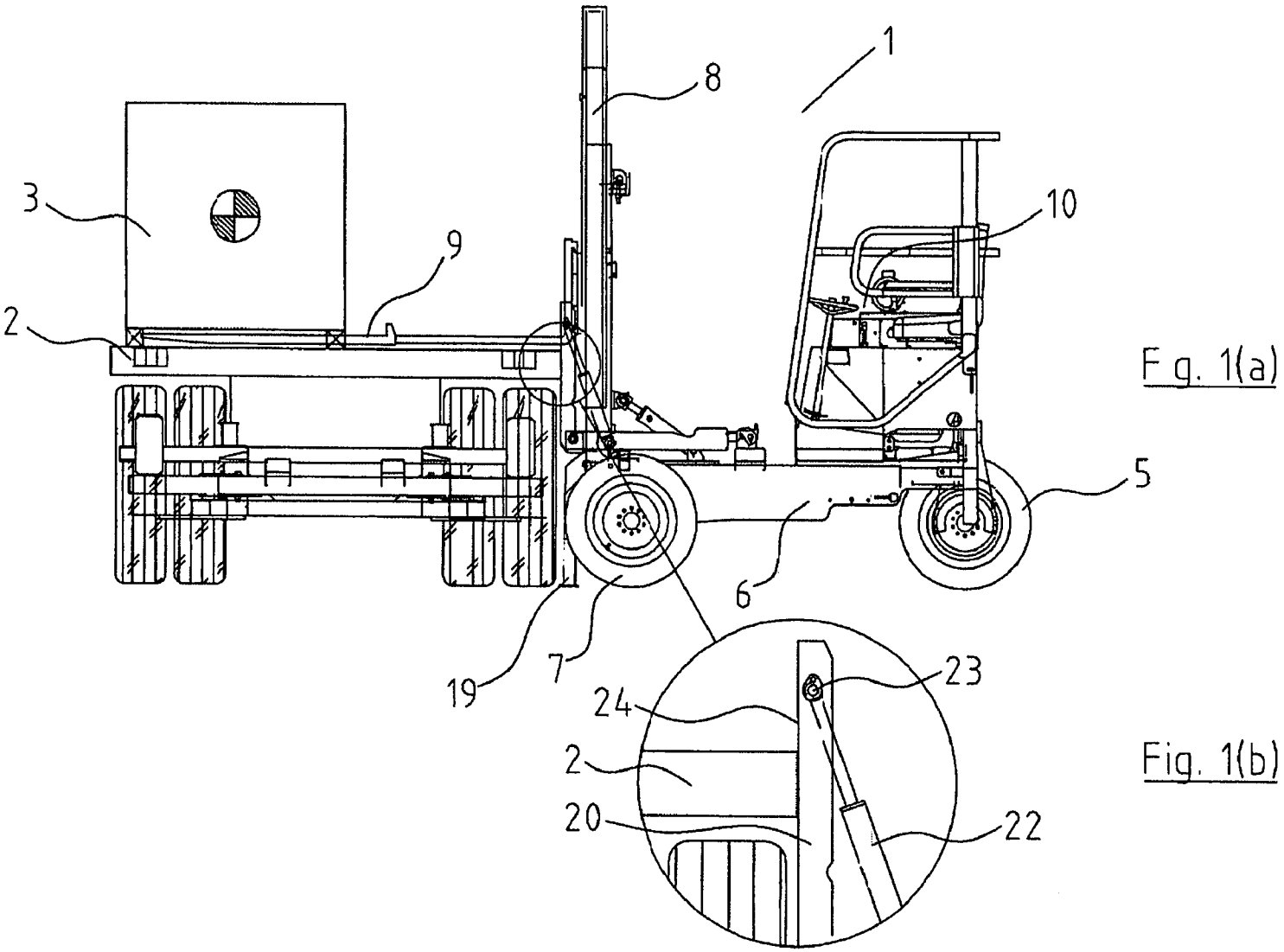
FIG. 1(*a*) is a side view of a forklift according to the invention loading a trailer, FIG. 1(*b*) is an enlarged view of the circled portion of FIG. 1(*a*)
Figure 2:
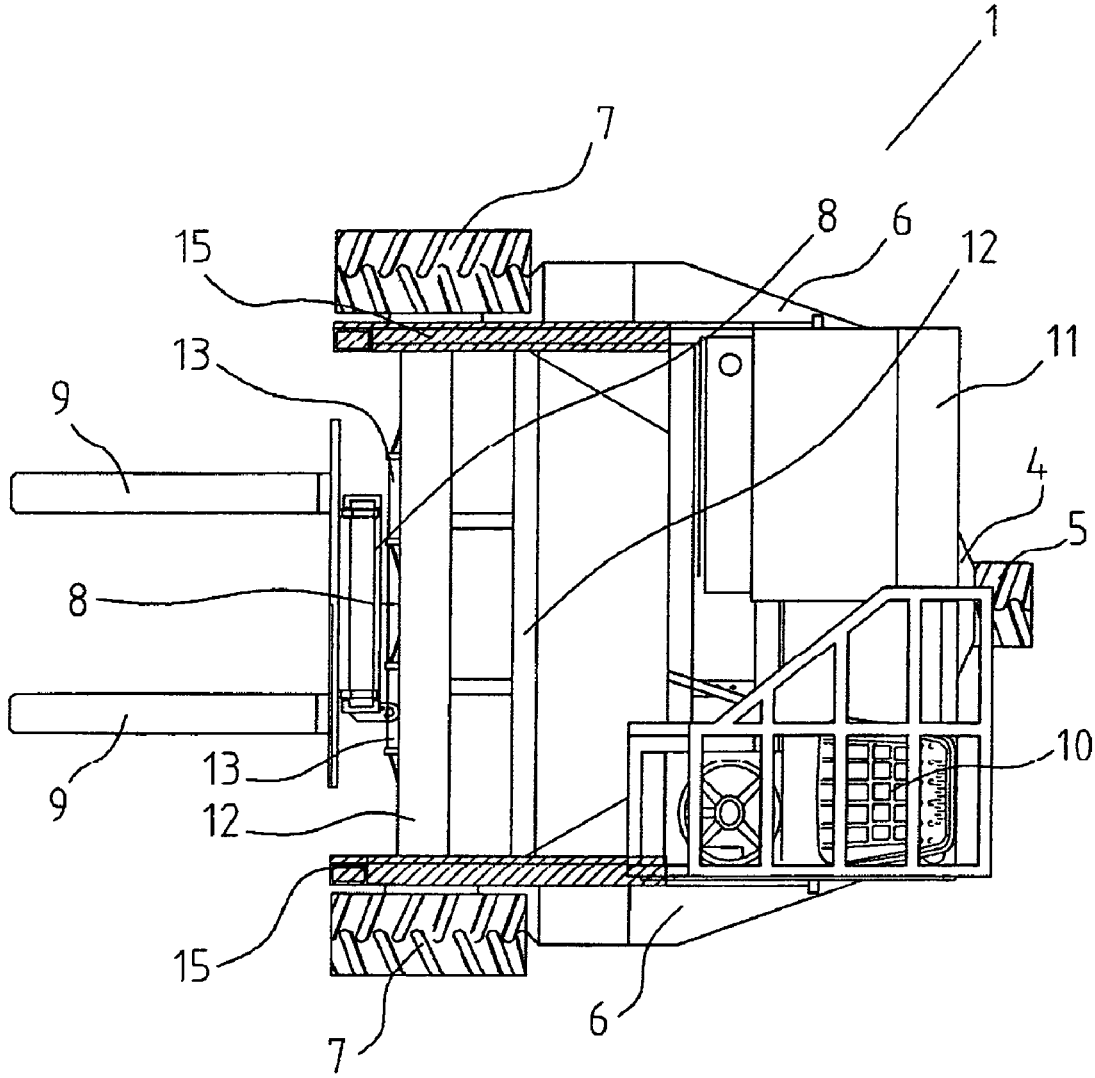
FIG. 2 is a plan view of the forklift illustrated in FIG. 1, FIGS. 3(*a*) to (*c*) illustrate a platform engaging load rest support forming part of the forklift of FIGS. 1 and 2, in three positions of use, FIG. 4(*a*) shows portion of the forklift with the load rest raised, FIG. 4(*b*) is an enlarged view of the circled portion illustrated in FIG. 4(*a*), FIG. 5(*a*) is a side view of the forklift with the load rest lowered FIG. 5(*b*) is an enlarged view of the portion circled in FIG. 5(*a*), FIG. 6(*a*) is a side view of the forklift with the load rest unfolded FIG. 6(*b*) is an enlarged view of the circled portion of the forklift illustrated in FIG. 6(*a*), FIG. 7(*a*) to FIG. 7(*f*) and FIG. 8(*a*) to FIG. 8(*d*) show the operation of the forklift and the load rest.
Figure 3A:
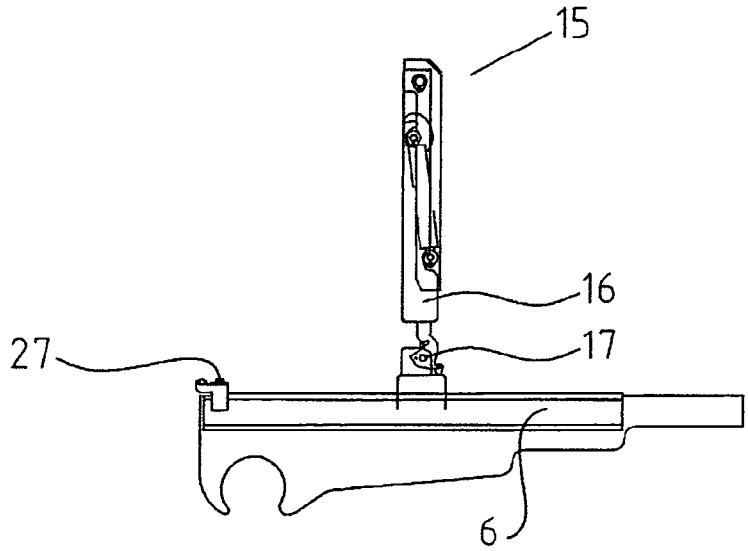
Figure 3B:
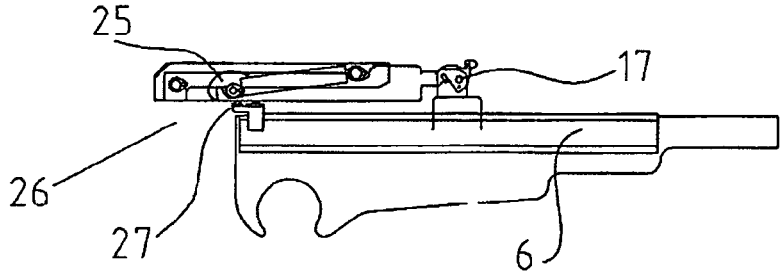
Figure 3C:
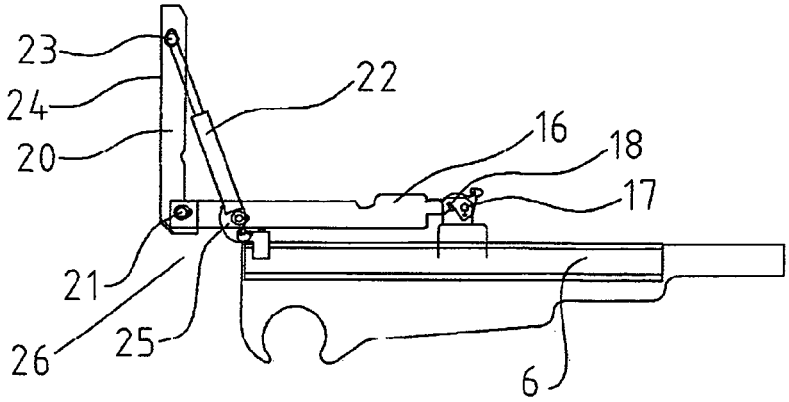

Referring to the drawings and initially to FIGS. 1 to 3 thereof, there is provided a forklift truck adapted for carrying on a vehicle, indicated generally by the reference numeral 1, loading a platform, in this case, a trailer 2 with a load 3. The forklift 1 has a U-shaped chassis comprising a base frame 4 mounting a rear steering wheel 5 and a pair of forwardly projecting side frames 6 each mounting a front wheel 7. The forklift 1 mounts an upright mast 8 carrying forks, in this case, extendable forks 9, which allow for the extension of the forks 9 relative to the mast 8 to be altered. A drive station 10 and a motor 11 are also shown. The upright mast 8 is mounted on a mast carriage 12 which is movable forwards and backwards within the U-shaped chassis. A side-shift mechanism, namely a hydraulic ram 13, is provided to side-shift the mast 8 on the carriage 12. The mast 8 is shown in its extended position in all the Figs., except FIGS. 7 and 8, where it is shown extended and retracted to lie rearwardly of the position, illustrated in FIGS. 1 and 2, to rest between the side frames 6. Mounted on each side frame 6 is a platform engaging load rest support, indicated generally by the reference numeral 15. Ground engaging stabilising jack legs 19 are provided. Ideally, the jack legs 19 are configured to engage the ground in a position forward of the contact surface of the rest support with the platform.

Figures 4A, 4B:
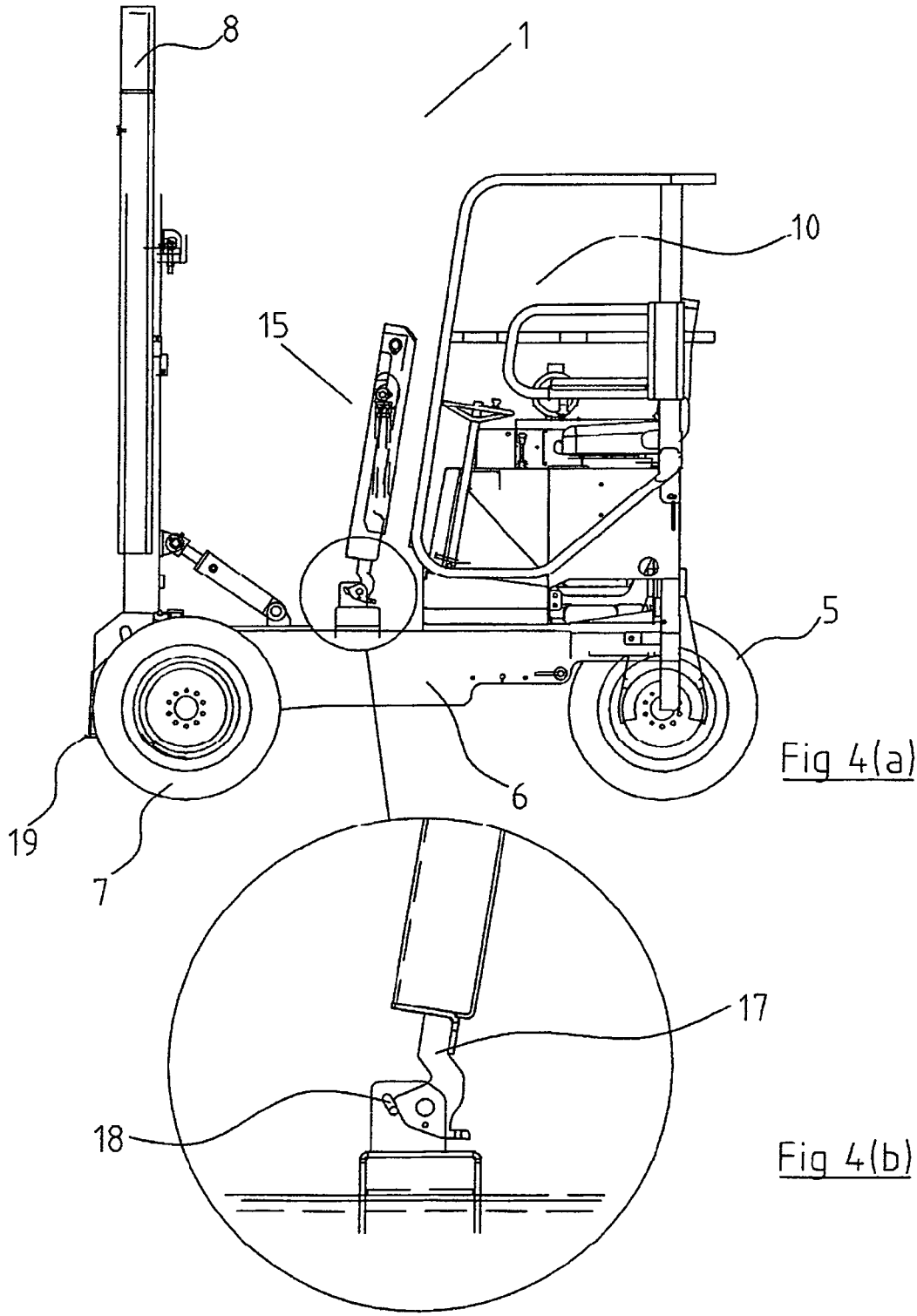

Referring now specifically to FIG. 3, the rest support 15 comprises a base frame 16 mounted by a pivot mount 17 having a locking pin 18 (shown in more detail in FIG. 4(*b*)) for storing the rest support 15 in an upright position. A bar 20 is pivotally mounted at 21 on the base frame 16 and in turn mounts a ram 22 pivotally connected thereto at 23. The bar 20 of the rest support 15 provides a contact surface 24 for the rest support 15. The ram 22 mounts at its other end a hook 25, shown in more detail in FIGS. 5 and 6, for engagement with a frame locking pin 27 on the side frame 6. The hook 25 and pin 27 form a connection means, indicated generally by the reference numeral 26. The platform, namely, the trailer 2 also offers or provides a facing surface to engage against the contact surface 24. This facing surface is identified by the letter Y as it is not a fixed surface but depends on the position of the forklift 1 relative to the platform and can vary in use.

Figures 5A, 5B:
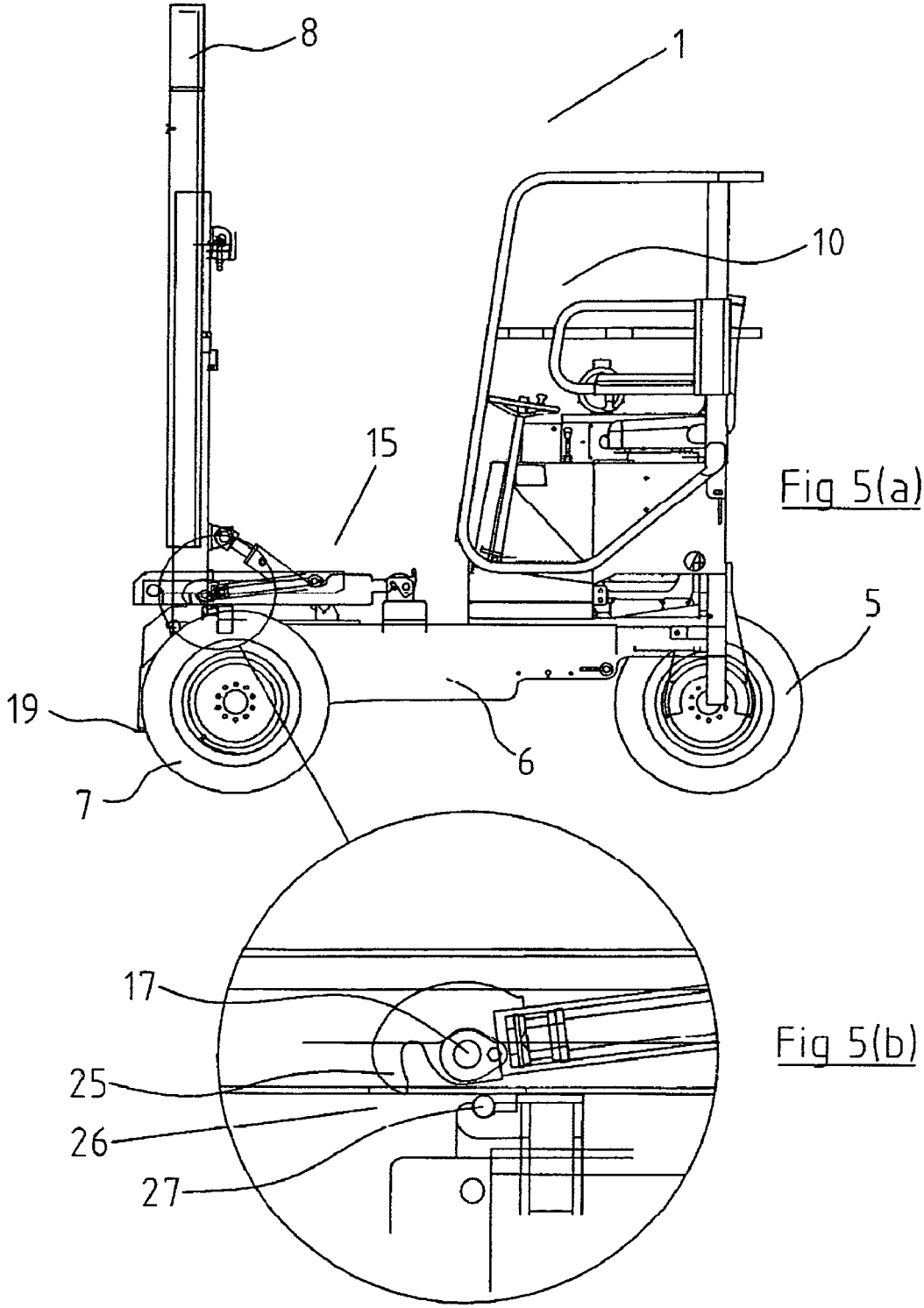
Figures 6A, 6B:
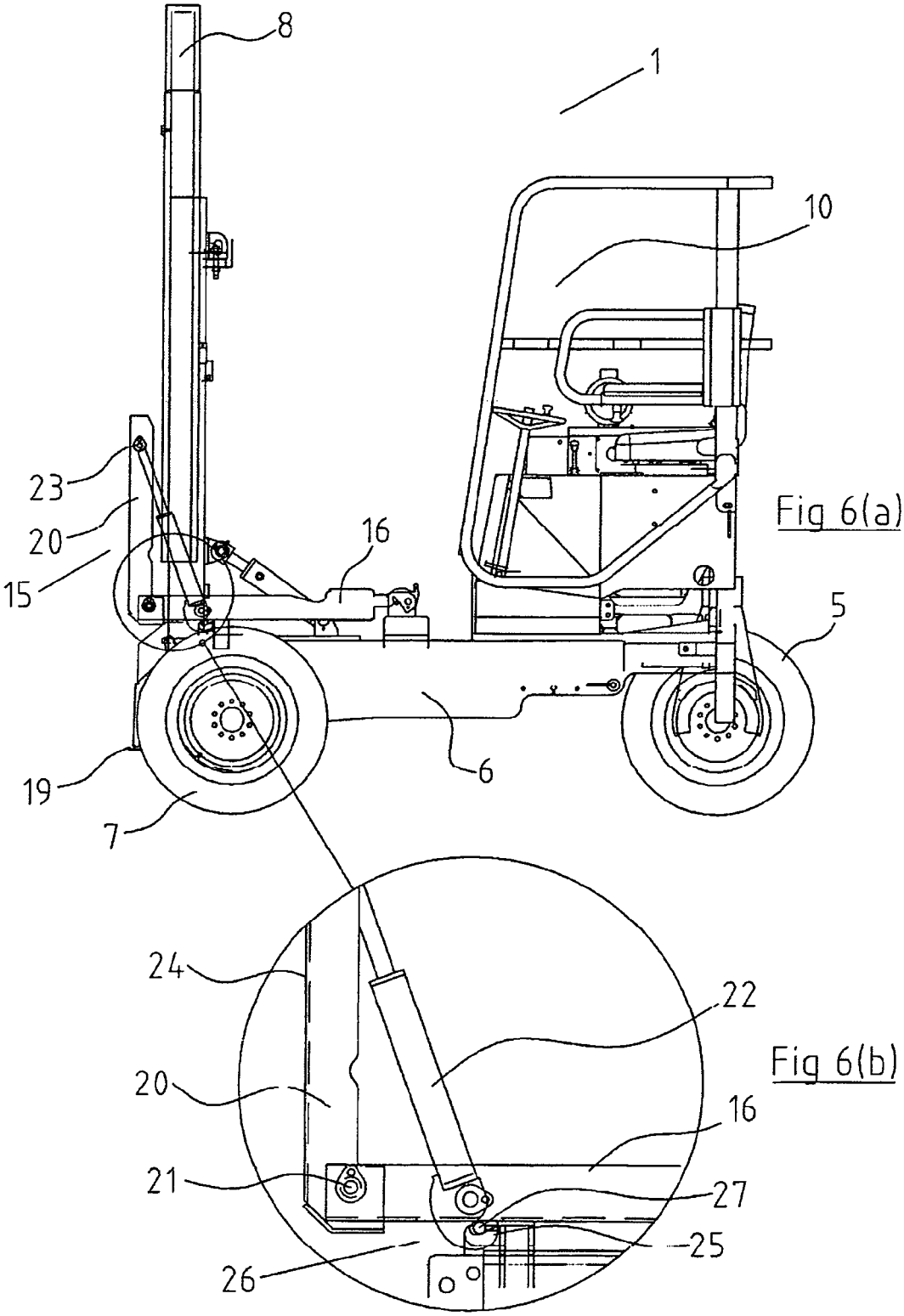
Figure 7A:
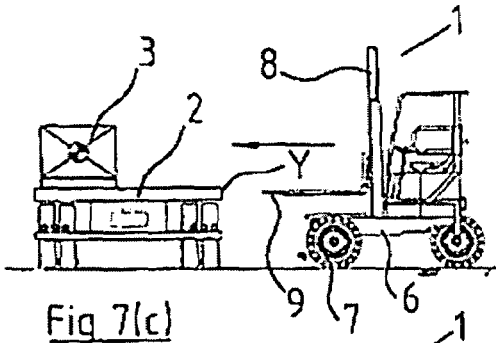
Figure 7B:
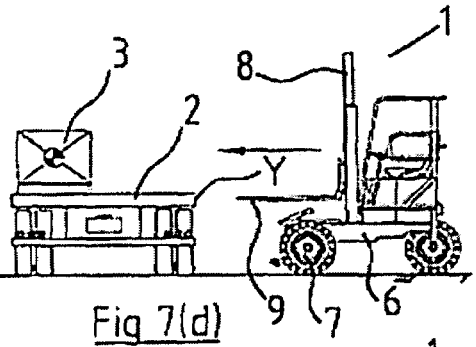
Figure 7C:
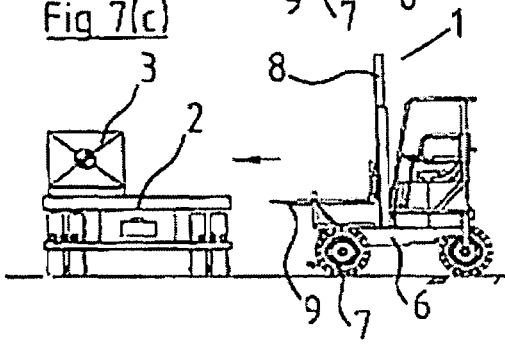
Figure 7D:
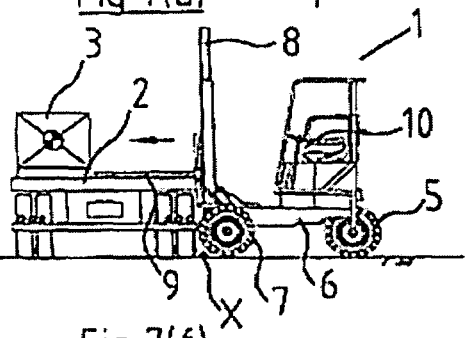
Figure 7E:
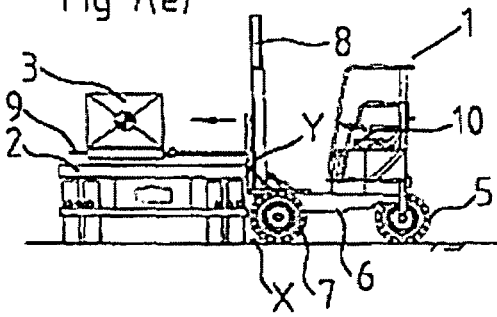
Figure 7F:
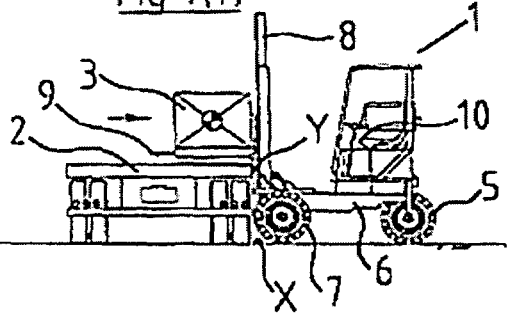

In operation, to erect the rest support 15, the locking pin 18 is released and the rest support 15, which is in the position illustrated in FIG. 3(*a*) and in FIG. 4, is pivoted downwards to lie in the position illustrated in FIG. 3(*a*) and in FIG. 5. Then, the ram 22 is operated to extend itself which causes the bar 20 to pivot upwards and for the hook 25 to engage the pin 27 and to lock firmly in the upright position.

Figures 8A, 8B, 8C, 8D:
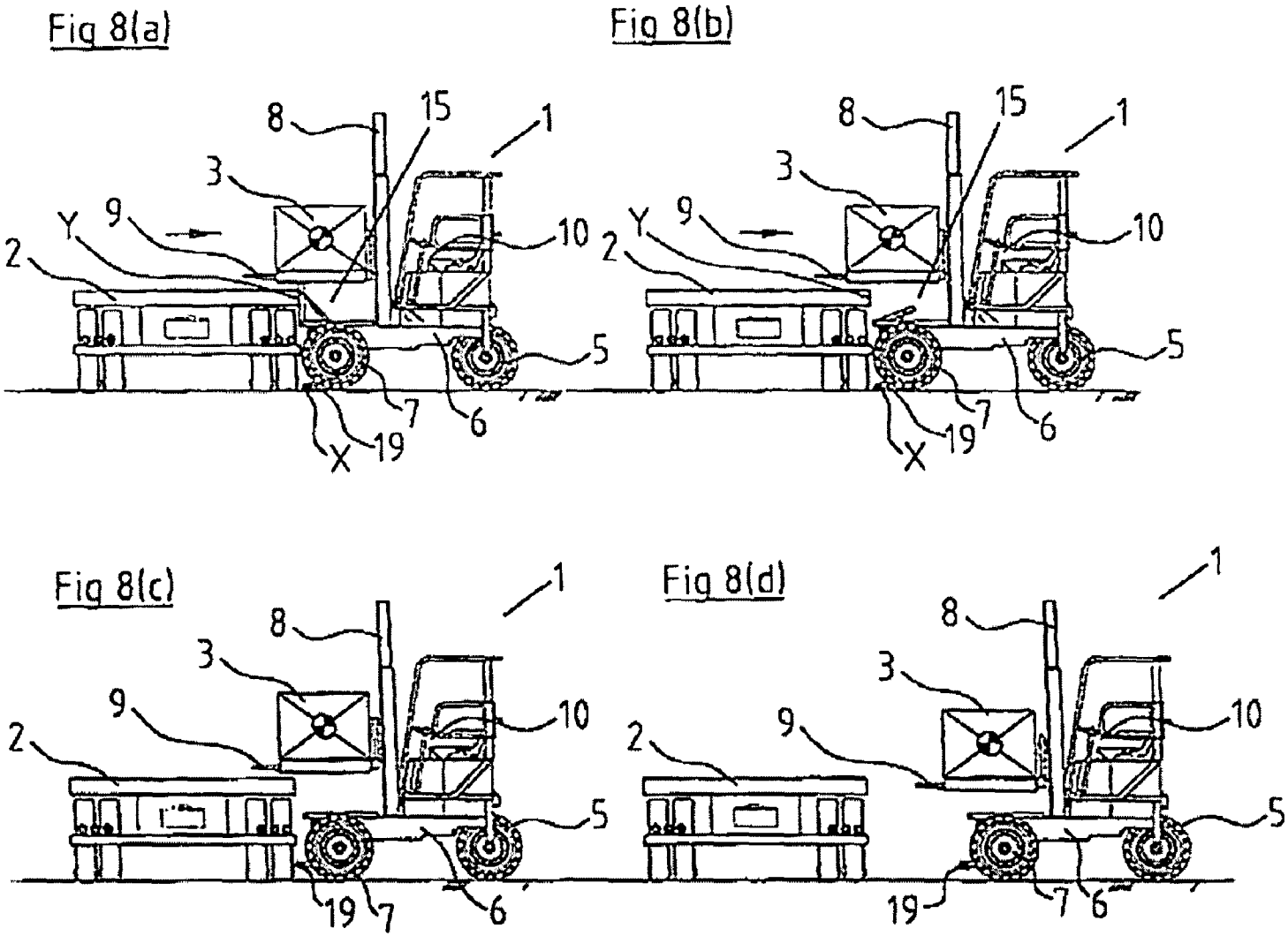

Now referring to FIGS. 7 and 8, there is illustrated the various steps of the operation of the forklift.

In FIG. 7(*a*), the forklift 1 is driven in the direction of the platform, namely, the trailer 2. In FIG. 7(*b*), the side rests 15 are shown being raised. In FIG. 7(*c*), the side rests 15 are shown fully raised. In FIG. 7(*d*), the mast carriage 12 is moved out, the forklift 1 is offered up against the platform 2 and the jack legs 19 are lowered. Then, in FIG. 7(*e*), the forks 9 are extended under the load 3. The forks 9 are raised and in FIG. 7(*f*), the load 3 is retracted by contracting the forks 9. In FIG. 8(*a*), the mast 8 is retracted within the chassis. The rest supports 15 are lowered in FIG. 8(*b*). The jack legs 19 are raised in (FIG. 8(*c*) and then, in FIG. 8(*d*), the forklift 1 is driven away from the platform 2 for transport of the load 3.

Figure 9:
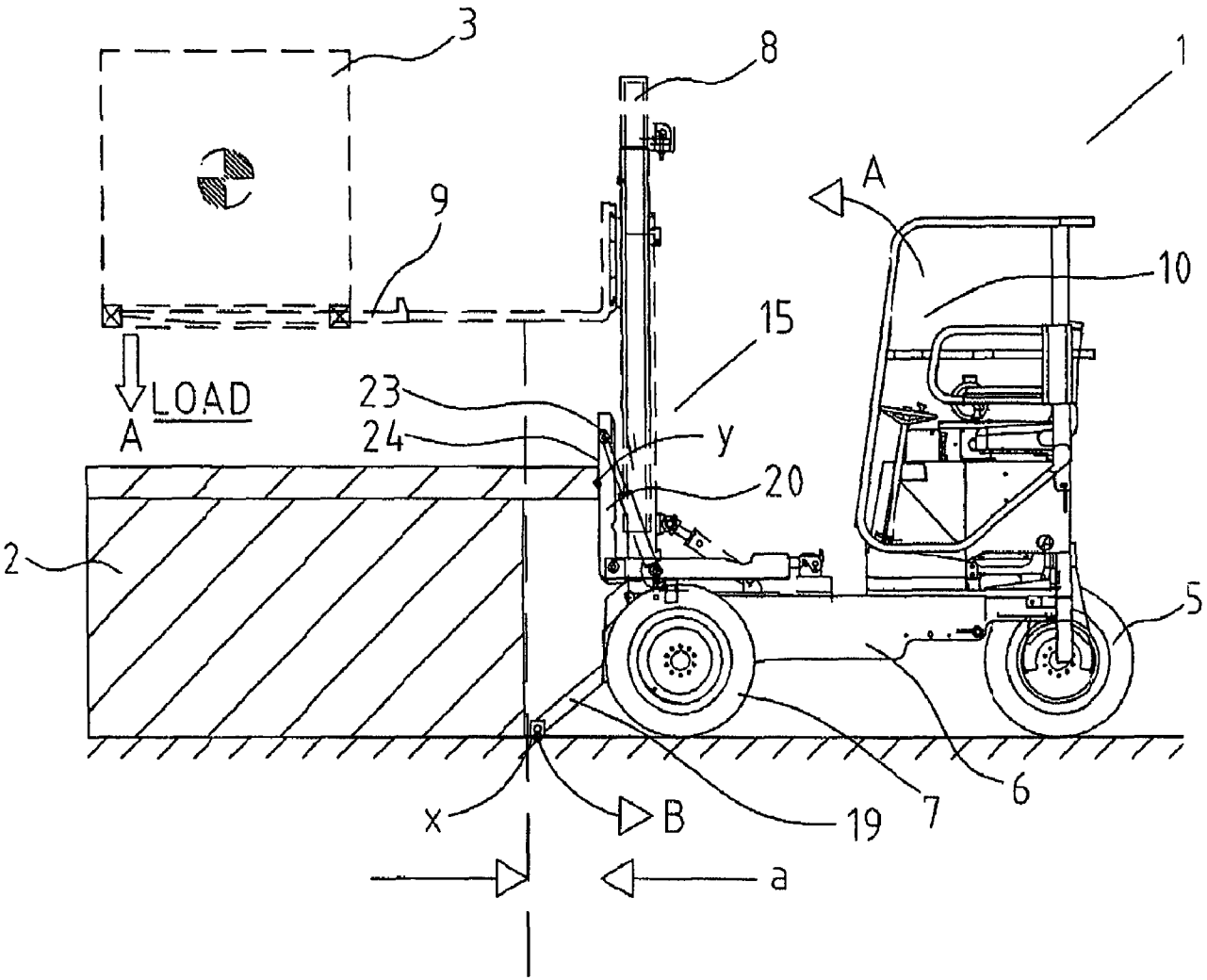
FIG. 9 is a diagrammatic view of the forklift in operation.

Referring now to FIG. 9, in which parts similar to those described, with reference to the previous drawings, are identified by the same reference numerals, however, substantial portions of both the platform, namely the trailer 2 and the forklift 1, are not shown. It will be seen that the contact surface 24 makes contact with the platform 2 along a line or contact area, namely the facing surface Y. The jack leg 19 contacts the ground along another contact area, identified by the reference letter X. There is a spacing or offset a between the two contact surfaces X and Y.

It will be appreciated that the contact surface at X is forward of the contact surface at Y. Thus, if a load 3, which would tend to cause the forklift 1 to pivot in the direction of the arrow A, acts on the forklift 1, the resultant reaction, identified by the arrow B, which will be about the contact at Y, will be to lock the forklift 1 against the platform 2 and thus prevent the forklift 1 from tipping. Now, both the weight of the forklift 1 and the platform 2 counteract tipping of the forklift 1. Where the platform 2 is a trailer, then this is just simply the weight of the trailer about the wheels most remote from the forklift 1 or where it is a rigid platform, it is the whole platform itself. Thus, everything prevents the forklift from tipping which will allow the mast of the forklift to be tilted and, if side shift is provided, to be easily shifted sideways because there will be no load on the mast or the forks other than that of the load.

Needless to say, it is not necessary that the jack legs 19 be always placed so that their contact surface engages a ground at a position forward of the contact surface of the rest support with the platform 2 as the force of the rest support 15 against the platform will lock them together which would be contrary to best practice. However, it is preferable that it should do so. In many instances, it will be more than likely almost coincident therewith which will, in practice, due to unevenness of grounds, etc., cause the forklift 1 to be rigidly held in position. When the jack leg 19 is somewhat behind the contact surface of the rest support with the platform, for example, where there were no jack legs 19 used and one is depending on the wheels of the forklift 1, the contact surface would provide additional support. It will be appreciated that in many instances, it will not be possible to achieve the ideal location of the jack legs because, very often, the platform being loaded will be a trailer or a truck, the tyres of which may prevent the jack legs being placed in the optimum position. Thus, very often, the jack legs will only be level with the tyres.

Figure 10:
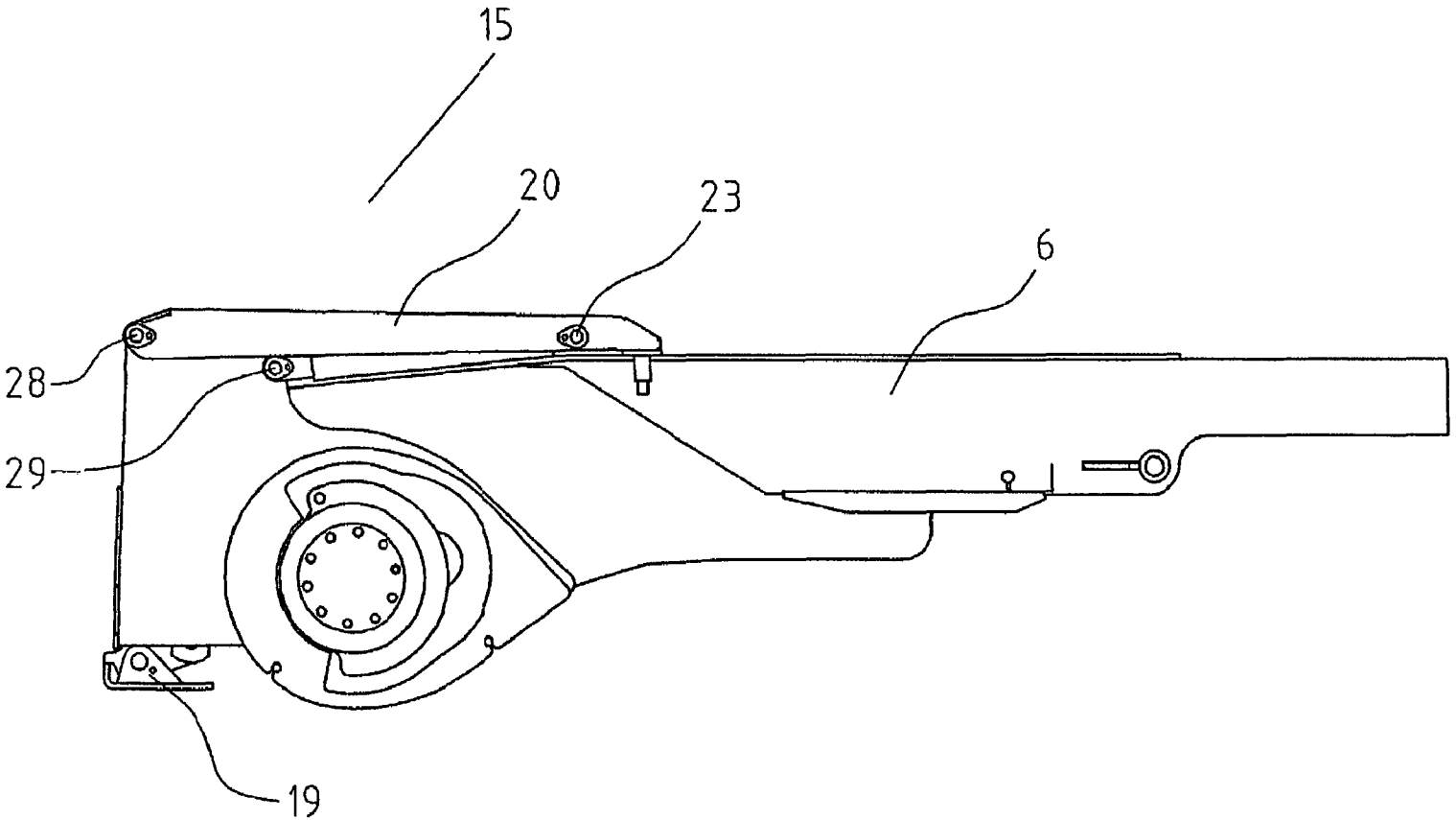
FIG. 10 illustrates an alternative construction of platform engaging load rest support on portion of a chassis of a forklift in the folded position.
Figure 11:
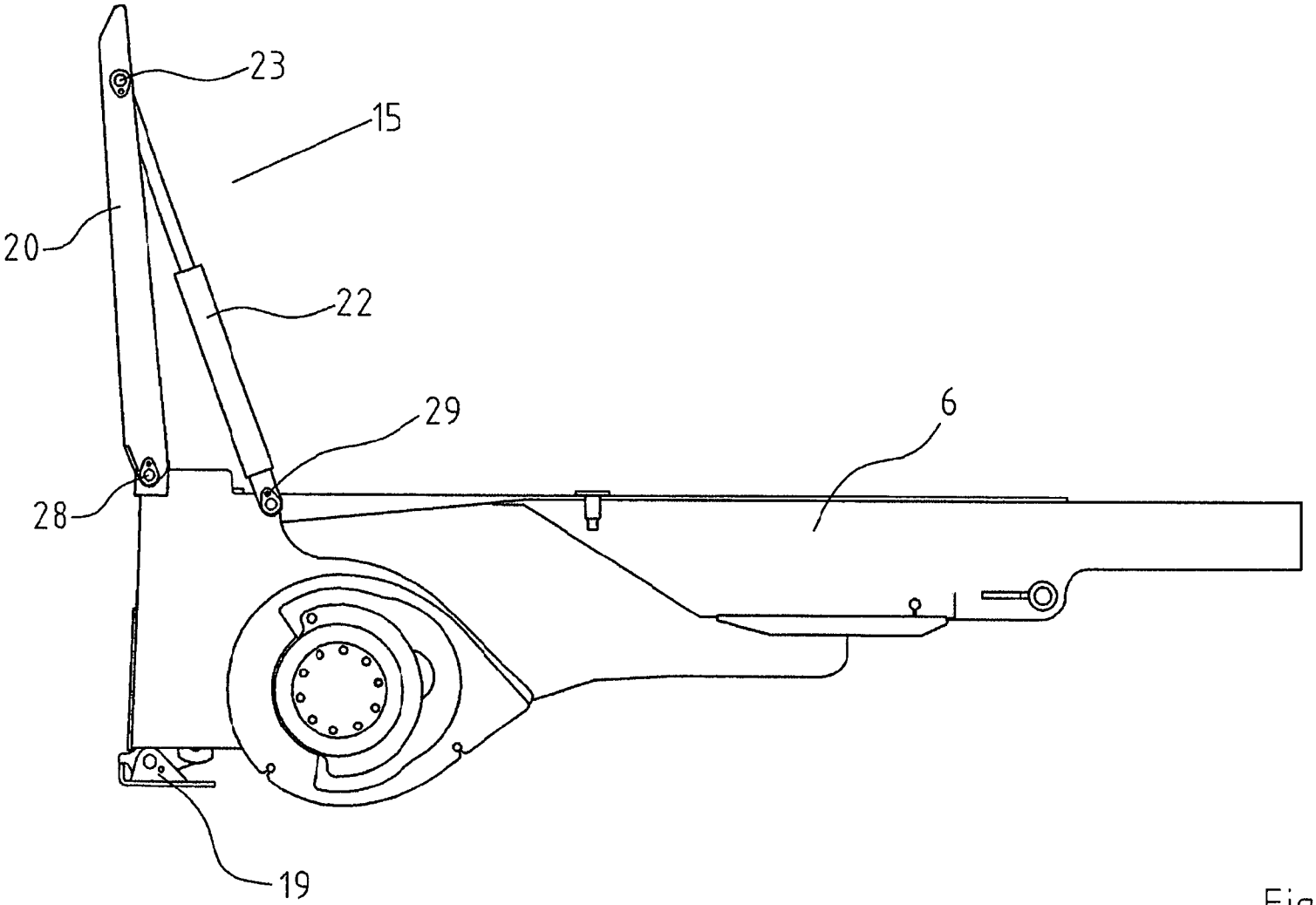
FIG. 11 shows the platform engaging load rest support of FIG. 10 in the operative position.

It will be appreciated that the construction of rest support can be of many forms. Referring to FIGS. 10 and 11, there is illustrated an alternative construction of load rest support, again indicated generally by the reference numeral 15, in which parts similar to those described with reference to the previous drawings, are identified by the same reference numerals. In this embodiment, the bar 20 is pivotally mounted at 28 on the side frame 6 and the ram 22 is now pivotally mounted at 29, also on the side frame 6. In this way, the rest supports are permanently mounted in position. This construction can only be used when a particular form of mounting on the carrying truck allows this. It will be appreciated that it is a simpler construction than the embodiment previously described. It will be noted that in this embodiment, the bar 20 is inclined or tilted slightly forwards, in practice, of the order of 2 to the vertical. In use, the operation of the jack legs tilt the machine slightly and this inclination of the bar ensures better contact with the platform.

Figure 12:
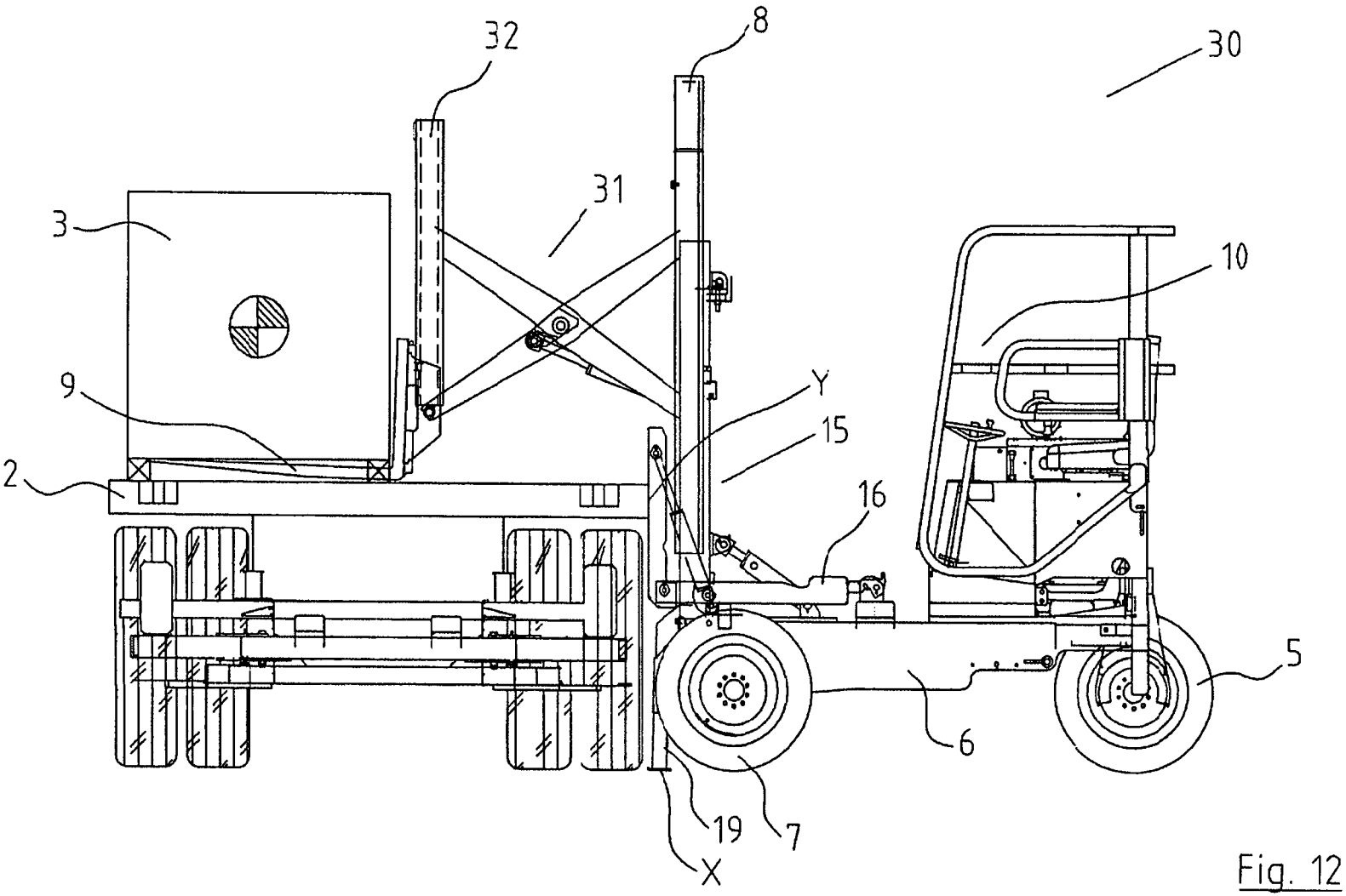
FIG. 12 is a view similar to FIG. 1 but showing a pantograph reach device.

Referring to FIG. 12, there is illustrated an alternative construction of forklift, indicated generally by the reference numeral 30, in which parts similar to those described, with reference to the previous drawings, are identified by the same reference numerals. In this embodiment, the means for altering the reach of the forks 9 relative to the mast 8 are provided by a pantograph linkage, indicated generally by the reference numeral 31. The forks 9 are mounted on a carriage 32 which is supported by the pantograph linkage 31.

In the specification the terms "comprise, comprises, comprised and comprising" or any variation thereof and the terms "include, includes, included and including" or any variation thereof are considered to be totally interchangeable and they should all be afforded the widest possible interpretation and vice versa.

The invention is not limited to the embodiment hereinbefore described, but may be varied in both construction and detail within the scope of the appended claims.

What is claimed is:

1. A forklift truck adapted to be mounted on a carrying vehicle comprising:

a chassis;

wheels on the chassis;

an upright mast;

means for mounting the upright mast on the chassis;

means for mounting load carrying forks on the mast;

means for altering the reach of the forks relative to the mast to remove and place loads on a platform; and a platform engaging rest support pivotally mounted to and from a storage position on the chassis independent of the upright mast, the platform engaging rest support having a platform engaging contact surface for engagement against a facing surface of the platform and the platform engaging rest support being pivotable to and from a substantial upright operating position forward of the mast.

2. The forklift according to claim 1, in which the contact surface of the rest support is substantially vertically in line with the foremost contact between the chassis and the ground.

3. The forklift according to claim 2, in which the rest support is tilted slightly forwards so that in the operative position and prior to full contact with the platform, the contact surface is inclined forwardly.

4. The forklift according to claim 2, in which there are a pair of spaced-apart rest supports on either side of the mast.

5. The forklift according to claim 2, in which the rest support comprises an upright bar mounted on the chassis.

6. The forklift according to claim 2, in which the rest support comprises a bar pivotally mounted with the respect to the chassis and a ram connected between the bar and the chassis for raising and lowering the bar.

7. The forklift according to claim 2, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar; and releasable connection means for mounting the ram on the chassis.

8. The forklift according to claim 2, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the chassis for releasable reception of the hook.

9. The forklift as claimed in claim 2, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the chassis for releasable reception of the hook; and locking means for retaining the base frame in an upright storage position on the chassis.

10. The forklift according to claim 1, in which the contact surface of the rest support is rearward of the foremost contact between the chassis and the ground.

11. The forklift according to claim 10, in which the rest support is tilted slightly forwards so that in the operative position and prior to full contact with the platform, the contact surface is inclined forwardly.

12. The forklift according to claim 10, in which there are a pair of spaced-apart rest supports on either side of the mast.

13. The forklift according to claim 10, in which the rest support comprises an upright bar mounted on the chassis.

14. The forklift according to claim 10, in which the rest support comprises a bar pivotally mounted with the respect to the chassis and a ram connected between the bar and the chassis for raising and lowering the bar.

15. The forklift according to claim 10, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar; and releasable connection means for mounting the ram on the chassis.

16. The forklift according to claim 10, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other free end of the ram; and a transversely arranged frame locking pin mounted above and spaced-apart from the chassis for releasable reception of the hook.

17. The forklift according to claim 10, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the chassis for releasable reception of the hook; and locking means for retaining the base frame in an upright storage position on the chassis.

18. The forklift according to claim 1, in which the rest support is tilted slightly forwards so that in the operative position and prior to full contact with the platform, the contact surface is inclined forwardly.

19. The forklift according to claim 18, in which there are a pair of spaced-apart rest supports on either side of the mast.

20. The forklift according to claim 18, in which the rest support comprises an upright bar mounted on the chassis.

21. The forklift according to claim 18, in which the rest support comprises a bar pivotally mounted with the respect to the chassis and a ram connected between the bar and the chassis for raising and lowering the bar.

22. The forklift according to claim 18, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar; and releasable connection means for mounting the ram on the chassis.

23. The forklift according to claim 18, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other free end of the ram; and a transversely arranged frame locking pin mounted above and spaced-apart from the chassis for releasable reception of the hook.

24. The forklift according to claim 18, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the chassis for releasable reception of the hook; and locking means for retaining the base frame in an upright storage position on the chassis.

25. A forklift truck adapted to be mounted on a carrying vehicle comprising:

a U-shaped chassis comprising a base frame and a pair of forwardly projecting side frames;

a rear steering wheel mounted on the base frame;

a front wheel mounted on each side frame;

an upright mast;

means for mounting the upright mast on the chassis;

means for mounting load carrying forks on the mast;

means for altering the reach of the forks relative to the mast to remove and place loads on a platform; and a platform engaging rest support, each rest support pivotally mounted to and from a storage position on each side frame independent of the upright mast, the platform engaging rest support having a platform engaging contact surface for engagement against a facing surface of the platform and the platform engaging rest support being pivotable to and from a substantial upright operating position forward of the mast.

26. The forklift according to claim 25, in which the contact surface of the rest support is substantially vertically in line with the foremost contact between the chassis and the ground.

27. The forklift according to claim 26, in which the rest support is tilted slightly forwards so that in the operative position and prior to full contact with the platform, the contact surface is inclined forwardly.

28. The forklift according to claim 26, in which there are a pair of spaced-apart rest supports on either side of the mast.

29. The forklift according to claim 26, in which the rest support comprises an upright bar mounted on the chassis.

30. The forklift according to claim 26, in which the rest support comprises a bar pivotally mounted with the respect to the chassis and a ram connected between the bar and the chassis for raising and lowering the bar.

31. The forklift according to claim 26, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar; and releasable connection means for mounting the ram on the chassis.

32. The forklift according to claim 26, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the chassis for releasable reception of the hook.

33. The forklift according to claim 26, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other free end of the ram;

a transversely arranged frame locking pin mounted above and spaced-apart from the chassis for releasable reception of the hook; and locking means for retaining the base frame in an upright storage position on the chassis.

34. The forklift according to claim 25, in which the contact surface of the rest support is rearward of the foremost contact between the chassis and the ground.

35. The forklift according to claim 34, in which the rest support is tilted slightly forwards so that in the operative position and prior to full contact with the platform, the contact surface is inclined forwardly.

36. The forklift according to claim 34, in which there are a pair of spaced-apart rest supports on either side of the mast.

37. The forklift according to claim 34, in which the rest support comprises an upright bar mounted on the chassis.

38. The forklift according to claim 34, in which the rest support comprises a bar pivotally mounted with the respect to the chassis and a ram connected between the bar and the chassis for raising and lowering the bar.

39. The forklift according to claim 34, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar; and releasable connection means for mounting the ram on the chassis.

40. The forklift according to claim 34, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the chassis for releasable reception of the hook.

41. The forklift according to claim 34 in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the chassis for releasable reception of the hook; and locking means for retaining the base frame in an upright storage position on the chassis.

42. The forklift according to claim 25, in which the rest support is tilted slightly forwards so that in the operative position and prior to full contact with the platform, the contact surface is inclined forwardly.

43. The forklift according to claim 25, in which there are a pair of spaced-apart rest supports on either side of the mast.

44. The forklift according to claim 25, in which the rest support comprises an upright bar mounted on the chassis.

45. The forklift according to claim 25, in which the rest support comprises a bar pivotally mounted with the respect to the chassis and a ram connected between the bar and the chassis for raising and lowering the bar.

46. The forklift according to claim 25, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar; and releasable connection means for mounting the ram on the chassis.

47. The forklift according to claim 25, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the chassis for releasable reception of the hook.

48. The forklift according to claim 25, in which the rest support comprises:

a base frame pivotally mounted adjacent one end thereof on the chassis;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the chassis for releasable reception of the hook; and locking means for retaining the base frame in an upright storage position on the chassis.

49. A forklift truck adapted to be mounted on a carrying vehicle comprising:

a U-shaped chassis comprising a base frame and a pair of forwardly projecting side frames;

a rear steering wheel mounted on the base frame;

a front wheel mounted on each side frame;

an upright mast;

means for mounting the upright mast on the chassis;

means for mounting load carrying extendible forks on the mast;

means for extending and retracting the forks to alter the reach of the forks relative to the mast to remove and place loads on a platform; and a platform engaging rest support, each rest support pivotally mounted to and from a storage position on each side frame independent of the upright mast, the platform engaging rest support having a platform engaging contact surface for engagement against a facing surface of the platform and the platform engaging rest support being pivotable to and from a substantial upright operating position forward of the mast.

50. The forklift according to claim 49, in which the contact surface of the rest support is substantially vertically in line with the foremost contact between the chassis and the ground.

51. The forklift according to claim 50, in which the rest support is tilted slightly forwards so that in the operative position and prior to full contact with the platform, the contact surface is inclined forwardly.

52. The forklift according to claim 50, in which the rest support comprises an upright bar mounted on the side frame.

53. The forklift according to claim 50, in which the rest support comprises a bar pivotally mounted with respect to the side frame and a ram connected between the bar and the side frame for raising and lowering the bar.

54. The forklift according to claim 50, in which the rest support comprises:

a base frame pivotally mounted adjacent one end thereof on each side frame;

a bar pivotally mounted on the base frame adjacent the other end thereof;

a ram, for raising and lowering the bar, pivotally connected at one end thereof to the bar intermediate the ends of the bar; and releasable connection means for mounting the ram on the base frame.

55. The forklift according to claim 50, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the side frame for releasable reception of the hook.

56. The forklift according to claim 50, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the side frame for releasable reception of the hook; and locking means for retaining the base frame in an upright storage position on the chassis.

57. The forklift according to claim 49, in which the contact surface of the rest support is rearward of the foremost contact between the chassis and the ground.

58. The forklift according to claim 57, in which the rest support is tilted slightly forwards so that in the operative position and prior to full contact with the platform, the contact surface is inclined forwardly.

59. The forklift according to claim 57, in which the rest support comprises an upright bar mounted on the side frame.

60. The forklift according to claim 57, in which the rest support comprises a bar pivotally mounted with respect to the side frame and a ram connected between the bar and the side frame for raising and lowering the bar.

61. The forklift according to claim 57, in which the rest support comprises:

a base frame pivotally mounted adjacent one end thereof on each side frame;

a bar pivotally mounted on the base frame adjacent the other end thereof;

a ram, for raising and lowering the bar, pivotally connected at one end thereof to the bar intermediate the ends of the bar; and releasable connection means for mounting the ram on the base frame.

62. The forklift according to claim 57, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the side frame for releasable reception of the hook.

63. The forklift according to claim 57, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the side frame for releasable reception of the hook; and locking means for retaining the base frame in an upright storage position on the chassis.

64. The forklift according to claim 49, in which the rest support is tilted slightly forwards so that in the operative position and prior to full contact with the platform, the contact surface is inclined forwardly.

65. The forklift according to claim 49, in which the rest support comprises an upright bar mounted on the side frame.

66. The forklift according to claim 49, in which the rest support comprises a bar pivotally mounted with respect to the side frame and a ram connected between the bar and the side frame for raising and lowering the bar.

67. The forklift according to claim 49, in which the rest support comprises:

a base frame pivotally mounted adjacent one end thereof on each side frame;

a bar pivotally mounted on the base frame adjacent the other end thereof;

a ram, for raising and lowering the bar, pivotally connected at one end thereof to the bar intermediate the ends of the bar; and releasable connection means for mounting the ram on the base frame.

68. The forklift according to claim 49, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the side frame for releasable reception of the hook.

69. The forklift according to claim 49, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the side frame for releasable reception of the hook; and locking means for retaining the base frame in an upright storage position on the chassis.

70. A forklift truck adapted to be mounted on a carrying vehicle comprising:

a U-shaped chassis comprising a base frame and a pair of forwardly projecting side frames;

a rear steering wheel mounted on the base frame;

a front wheel mounted on each side frame;

an upright mast;

means for mounting the upright mast on the chassis;

load carrying forks;

a pantograph linkage mounting the forks on the mast;

means for extending and retracting the linkage to alter the reach of the forks relative to the mast to remove and place loads on a platform; and a platform engaging rest support, each rest support pivotally mounted to and from a storage position on each side frame independent of the upright mast, the platform engaging rest support having a platform engaging contact surface for engagement against a facing surface of the platform and the platform engaging rest support being pivotable to and from a substantial upright operating position forward of the mast.

71. The forklift according to claim 70, in which the contact surface of the rest support is substantially vertically in line with the foremost contact between the chassis and the ground.

72. The forklift according to claim 71, in which the rest support is tilted slightly forwards so that in the operative position and prior to full contact with the platform, the contact surface is inclined forwardly.

73. The forklift according to claim 71, in which the rest support comprises an upright bar mounted on the side frame.

74. The forklift according to claim 71, in which the rest support comprises a bar pivotally mounted with respect to the side frame and a ram connected between the bar and the side frame for raising and lowering the bar.

75. The forklift according to claim 71, in which the rest support comprises:

a base frame pivotally mounted adjacent one end thereof on each side frame;

a bar pivotally mounted on the base frame adjacent the other end thereof;

a ram, for raising and lowering the bar, pivotally connected at one end thereof to the bar intermediate the ends of the bar; and releasable connection means for mounting the ram on the base frame.

76. The forklift according to claim 71, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the side frame for releasable reception of the hook.

77. The forklift according to claim 71, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the side frame for releasable reception of the hook; and locking means for retaining the base frame in an upright storage position on the chassis.

78. The forklift according to claim 70, in which the contact surface of the rest support is rearward of the foremost contact between the chassis and the ground.

79. The forklift according to claim 78, in which the rest support is tilted slightly forwards so that in the operative position and prior to full contact with the platform, the contact surface is inclined forwardly.

80. The forklift according to claim 78, in which the rest support comprises an upright bar mounted on the side frame.

81. The forklift according to claim 78, in which the rest support comprises a bar pivotally mounted with respect to the side frame and a ram connected between the bar and the side frame for raising and lowering the bar.

82. The forklift according to claim 78, in which the rest support comprises:

a base frame pivotally mounted adjacent one end thereof on each side frame;

a bar pivotally mounted on the base frame adjacent the other end thereof;

a ram, for raising and lowering the bar, pivotally connected at one end thereof to the bar intermediate the ends of the bar; and releasable connection means for mounting the ram on the base frame.

83. The forklift according to claim 78, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the side frame for releasable reception of the hook.

84. The forklift according to claim 78, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other free end of the ram;

a transversely arranged frame locking pin mounted above and spaced-apart from the side frame for releasable reception of the hook; and locking means for retaining the base frame in an upright storage position on the chassis.

85. The forklift according to claim 70, in which the rest support is tilted slightly forwards so that in the operative position and prior to full contact with the platform, the contact surface is inclined forwardly.

86. The forklift according to claim 70, in which the rest support comprises an upright bar mounted on the side frame.

87. The forklift according to claim 70, in which the rest support comprises a bar pivotally mounted with respect to the side frame and a ram connected between the bar and the side frame for raising and lowering the bar.

88. The forklift according to claim 70, in which the rest support comprises:

a base frame pivotally mounted adjacent one end thereof on each side frame;

a bar pivotally mounted on the base frame adjacent the other end thereof;

a ram, for raising and lowering the bar, pivotally connected at one end thereof to the bar intermediate the ends of the bar; and releasable connection means for mounting the ram on the base frame.

89. The forklift according to claim 70, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram; and a transversely arranged frame locking pin mounted above and spaced-apart from the side frame for releasable reception of the hook.

90. The forklift according to claim 70, in which the rest support comprises:

a base frame pivotally mounted adjacent one end thereof on each of the side frames;

a bar pivotally mounted on the base frame adjacent the other end thereof;

a ram, for raising and lowering the bar, pivotally connected at one end thereof to the bar intermediate the ends of the bar;

a hook mounted on the other end of the ram;

a transversely arranged frame locking pin mounted above and spaced-apart from the side frame for releasable reception of the hook; and locking means for retaining the base frame in an upright storage position on the chassis.

* * * * *